US012765674B2

(12) United States Patent
Letow et al.

(10) Patent No.: US 12,765,674 B2
(45) Date of Patent: Oct. 20, 2026

(54) CHAIR WITH HEIGHT ADJUSTMENT BASED ON SEAT POSITIONING AND FURNITURE COMPOSITION

(71) Applicant: Vitra AG, Birsfelden (CH)

(72) Inventors: Eugen Letow, Lörrach (DE); Stefan Keller, Steinen-Hofen (DE); Noah Friedlin, Basel (CH)

(73) Assignee: Vitra AG, Birsfelden (CH)

( * ) Notice: Subject to any disclaimer, the term of this patent is extended or adjusted under 35 U.S.C. 154(b) by 128 days.

(21) Appl. No.: 18/664,752

(22) Filed: May 15, 2024

(65) Prior Publication Data

US 2024/0382001 A1 Nov. 21, 2024

(30) Foreign Application Priority Data

May 16, 2023 (EP) ..... 23173669

(51) Int. Cl.

| | |
|---|---|
| ***A47C 3/30*** | (2006.01) |
| ***A47C 3/026*** | (2006.01) |
| *A47B 83/02* | (2006.01) |
| *A47C 3/22* | (2006.01) |

(52) U.S. Cl.

CPC ..... *A47C 3/30* (2013.01); *A47C 3/026* (2013.01); *A47B 83/02* (2013.01); *A47C 3/22* (2013.01)

(58) Field of Classification Search

CPC ..... A47C 3/026; A47C 3/30

See application file for complete search history.

(56) References Cited

U.S. PATENT DOCUMENTS

| | | | | | |
|---|---|---|---|---|---|
| 3,603,553 | A * | 9/1971 | Doerner | A47C 7/443 | 248/596 |
| 4,328,943 | A * | 5/1982 | Eldon, III | A47C 7/443 | 248/161 |
| 4,408,800 | A * | 10/1983 | Knapp | A47C 1/03283 | 297/285 |
| 4,779,925 | A * | 10/1988 | Heinzel | A47C 1/03238 | 297/303.3 |
| 5,224,758 | A * | 7/1993 | Takamatsu | A47C 7/444 | 297/300.5 |

(Continued)

FOREIGN PATENT DOCUMENTS

| | | | | |
|---|---|---|---|---|
| CN | 111557563 A * | 8/2020 | A47C 7/34 | |
| DE | 4303021 A1 * | 8/1994 | A47C 1/03283 | |

(Continued)

*Primary Examiner* — Joseph W Sanderson
(74) *Attorney, Agent, or Firm* — MEDLER FERRO WOODHOUSE & MILLS PLLC

(57) ABSTRACT

A chair comprises a seat with a seat carrier comprising a buttock section at the rear and a knee section at the front, a height adjustment device coupled to the seat, and a foot part configured to be placed on a surface. The height adjustment device is configured to change the distance between the seat and the foot part. The seat is designed in such a manner that a height of the buttock section of the seat carrier and a height of the knee section of the seat carrier can be changed relative to one another. The chair further comprises a blocking structure configured to block the height adjustment device when the height of the buttock section of the seat carrier and the height of the knee section of the seat carrier are in a target position relative to one another.

14 Claims, 6 Drawing Sheets

(56) References Cited

U.S. PATENT DOCUMENTS 5,388,889 A * 2/1995 Golynsky ..... A47C 3/026 297/303.3
5,547,252 A 8/1996 Pfenniger
6,213,552 B1 * 4/2001 Miotto ..... A47C 1/03266 297/301.4
7,303,233 B2 * 12/2007 Kitahata ..... A47C 7/448 297/301.6
7,857,390 B2 * 12/2010 Schmitz ..... A47C 31/126 297/300.1
8,167,373 B2 * 5/2012 Allison ..... A47C 3/30 297/344.19
10,368,637 B2 * 8/2019 Lenz ..... A47C 3/20
10,485,346 B2 * 11/2019 Jones ..... A47C 1/03238
11,937,708 B2 * 3/2024 Zoell ..... F16C 1/16
12,108,882 B2 * 10/2024 Hayashi ..... A47C 3/026
2007/0052270 A1 * 3/2007 Kitahata ..... A47C 3/30 297/270.1
2009/0261637 A1 * 10/2009 Schmitz ..... A47C 3/026 297/217.2
2009/0302657 A1 * 12/2009 Allison ..... A47C 3/30 248/161
2018/0020831 A1 1/2018 Lenz
2019/0223598 A1 * 7/2019 Jones ..... A47C 1/03255
2020/0405056 A1 * 12/2020 Zoell ..... A47C 9/025
2021/0085083 A1 * 3/2021 Beech ..... A47C 1/0242
2023/0109498 A1 * 4/2023 Hayashi ..... A47C 1/03288 297/259.3

FOREIGN PATENT DOCUMENTS

DE 4309439 A1 * 9/1994 ..... A47C 7/443
WO WO-2014021796 A1 * 2/2014 ..... A47C 3/026
WO WO-2021156847 A1 * 8/2021 ..... A63B 24/0087

* cited by examiner

CHAIR WITH HEIGHT ADJUSTMENT BASED ON SEAT POSITIONING AND FURNITURE COMPOSITION

CROSS-REFERENCE TO RELATED APPLICATION(S)

The present application claims priority to European Patent Application No. 23173669.5 filed on May 16, 2023, the entire contents of which are incorporated by reference herein.

TECHNICAL FIELD

The invention relates to a chair and to a furniture composition comprising such a chair. Such chairs with a seat comprising a seat carrier with a rear buttock section and a front knee section, a height adjustment device coupled to the seat, and a foot part, wherein the height adjustment device is configured to change a distance between the seat and the foot part, can be used, for example, as swivel chairs in offices or other workplaces.

BACKGROUND

Chairs that are height-adjustable are often used at office workstations and other workplaces. Typically, a distance between a foot of the chair and a seat of the chair can be adjusted by means of a specific device. In addition, such chairs can also be rotatable and their seat and backrest angle can be adjusted. As people often sit at a desk for long periods of time in offices, for example, the adjustability of chairs is very important for ergonomic reasons.

In particular, setting a seat height that is adapted to the respective user is extremely important for comfortable, ergonomic and healthy sitting. In modern offices, where workstations are changed relatively frequently, it is an advantage if the seat height can be changed and adjusted as easily as possible.

Well-known office swivel chairs often have a column-like gas spring that pushes the seat away from the foot. A lever is then typically used to adjust the seat height. To reduce the seat height, the gas spring is compressed by loading the seat when the lever is actuated, and to increase the seat height, the seat is relieved so that the gas spring moves the seat vertically upwards relative to the foot.

In addition to gas springs, other height adjustment mechanisms are also known to change the seat height, for example by turning or other actuation.

Although many chairs and particularly office chairs can be precisely adjusted, the seat height is often not ideally adapted to the user during use. This may be because the user is not sufficiently aware of what their ideal seat height is, or because the seat height mechanisms are too complicated to operate. What's more, with frequently changing workstations, many users find it too inconvenient to adjust the chair for a short time.

The object of the following invention is therefore to propose a chair with which a seat height can be individually adjusted comparatively easily and reliably. It is particularly desirable to ensure that the height of office chairs and other chairs is always or frequently adjusted to the respective user.

SUMMARY OF THE INVENTION

In one aspect, the invention is a chair comprising a seat, a height adjustment device, a foot part and a blocking structure. The seat has a seat carrier with a rear buttock section and a front knee section. The height adjustment device is coupled to the seat. The foot part is configured to be placed on a surface. The height adjustment device is configured to change the distance between the seat and foot part. The seat is designed in such a manner that a height of the buttock section of the seat carrier and a height of the knee section of the seat carrier can be changed in relation to one another. The blocking structure is configured to block the height adjustment device when the height of the buttock section of the seat carrier and the height of the knee section of the seat carrier are in a target position relative to one another.

In principle, the chair can be any chair. However, the invention can be particularly advantageous for a chair that is used comparatively frequently by different users. In particular, the chair can be an office chair or an office swivel chair.

The foot part can be constructed like a stand and fitted with several contact elements that make contact with the base when the chair is in place. This allows the chair to stand sturdily on the base and provide stable support for the seated user. The contact elements can be designed as rollers, for example.

In the context of the invention, the term "seat carrier" refers to a bearing structure of the seat that forms or supports a seat surface. For example, the seat carrier can be designed directly as a seat plate, which has the seat surface, or comprise such a plate. The seat surface can be provided with a cushion or similar element to improve seating comfort. Or the seat carrier can hold or support such a seat plate. Alternatively, or additionally, the seat carrier may be or comprise a frame-like structure on which a textile or other flexible structure forming the seat surface is stretched or held in a similar manner.

The buttock section can be an area or portion of the seat carrier that is substantially loaded by the user's buttock when the chair is used as intended. In particular, it can be adjacent to the user's buttock or pick them up directly. Typically, the buttock section is in a rear part of the chair or its seat.

Similarly, the knee section can be an area or portion of the seat carrier that is loaded by the user's knees or part of the legs close to the knees when the chair is used as intended. Typically, the knee section is in a front part of the chair.

By changing the distance between the seat and foot part, the height adjustment device can adjust the seat height of the chair. This allows the seat height to be adjusted to suit the user.

The blocking structure can be designed in different manners to block the height adjustment device. For example, it may have a sliding element that is placed in the way or intervenes to block the height adjustment device in a suitable way for height adjustment. Like this, the height adjustment device can be blocked by preventing it from moving. In another example, the blocking structure can block the height adjustment device by disengaging it from the seat and/or the foot part. In this manner, the height adjustment device can no longer exert any effect on the seat or foot part in the blocked state. In a particularly advantageous embodiment, as described in more detail below, for example, the height adjustment device has a gas spring and the blocking structure comprises elements or a mechanism which actuates a valve of the gas spring. The mechanism can be designed in different manners to match the design of other components of the chair. A possible such mechanism with slide, guide and rocker is described in more detail below. To unblock the height adjustment device, the blocking structure can actuate the valve again.

The height adjustment device can be blocked by the blocking structure in such a manner that the distance between the seat and foot part can no longer be changed as long as the seat is loaded by the user or as long as the user is sitting on the chair. For example, blocking the height adjustment device can prevent the seat height from being adjusted when the user is sitting on the chair and the seat height is set. In particular, this automatically prevents the seat height from being adjusted as soon as the buttock section and the knee section are in the target position in relation to one another.

The target position of the buttock section and the knee section can be intended to or cause the knees and the buttocks or the thighs of the user to also be in a target position or in a target alignment when the height adjustment element is blocked by the blocking structure. In particular, this allows the height adjustment to be locked at a target inclination of the user's thighs. For example, a target inclination can define an approximately horizontal alignment of the thighs. For example, if the thighs are substantially horizontal, it can be assumed that the seat height is set correctly.

With the blocking structure according to the invention, the chair can therefore be automatically adjusted to a suitable individual seat height. For example, an automatic height adjustment system can be provided to ensure that the user always finds a preferred or suitable seat height. This can be particularly advantageous for frequently changing users. It makes it comparatively easy and reliable to automatically and individually adjust the seat height and ensures that the chair is always adjusted to the respective user as soon as they sit on it.

The height of the buttock section of the seat carrier and the height of the knee section of the seat carrier in relation to each other can also be referred to as the height ratio between the buttock section and the knee section. This height ratio can be varied in different ways. In one possible embodiment, the seat carrier is divided so that the buttocks and knee sections can be adjusted independently of one another. For example, the buttock section can be formed by a separate portion or component of the seat carrier that is flexible or movable in height compared to or in relation to the rest of the seat carrier.

Preferably, in order to change the height of the buttock section of the seat carrier and the height of the knee section of the seat carrier relative to one another, the seat is configured to tilt the seat carrier about a tilting axis, wherein the blocking structure is configured to block the height adjustment device when the seat carrier of the seat is tilted to a predefined target inclination. The tilting axis can be a physical element, such as a rod-shaped axis or rotatable fastening. Or it can be a quasi-virtual axis formed by other elements or components. A tilt of the seat carrier—i.e. the position of the buttock section and the knee section relative to one another—can define the alignment of the chair user's thighs. The target inclination can be defined in such a manner that the thighs are virtually horizontal.

The seat preferably defines a seat direction from the buttock section to the knee section, wherein the tilting axis preferably extends substantially at right angles to the seat direction and wherein further preferably the seat carrier is mounted so as to tilt about the tilting axis. In this embodiment, the tilting axis can be realized particularly as a stable physical component.

Preferably, the seat comprises a seat carrier pressure element which presses the height of the buttock section of the seat carrier and the height of the knee section of the seat carrier towards each other to a home position, wherein the home position is different from the target position. Advantageously, the height of the buttock section is greater than the height of the knee section in the basic position. For example, when sitting on the chair, it can be taken into account that the user's legs are comparatively stretched at the start of sitting-down and bend more and more as they sit down. In the case of a tilting seat carrier, the basic position can be an inclined position in which one seat surface of the seat slopes upwards from front to back.

The seat carrier pressure element preferably comprises a spring. For example, the spring can be a spiral spring or a torsion spring acting on the tilting axis. Such a spring enables a comparatively simple and efficient realization of the seat carrier pressure element.

In a preferred embodiment, the height adjustment device comprises a height pressure element that pushes the seat away from the foot part.

A chair with such a height pressure element can also be implemented without a blocking structure. Particularly, such a chair may have: a seat comprising a seat carrier having a rear buttock portion and a front knee portion, a height adjustment device coupled to the seat, and a foot part configured to be placed on a surface. The height adjustment device is configured to adjust a distance between the seat and the foot part, and the seat is designed in such a manner that a height of the buttock section of the seat carrier and a height of the knee section of the seat carrier can be changed relative to one another, wherein the height adjustment device has a height pressure element which pushes the seat away from the foot part.

Additionally, such a chair not comprising a blocking structure may have the features of the preferred embodiments of the chair with blocking structure listed above and below.

By pushing the seat away from the foot part, the height pressure element can ensure that the chair is in the maximum seat height or home position when the seat carrier is not loaded or the chair is not in use. The height pressure element can also be used to help the user stand up. For example, an elderly or mobility-impaired user can be supported when standing up by means of the height pressure element.

Various elastic or resilient structures can be used as vertical pressure elements. The blocking structure can be designed in different ways depending on the type of vertical pressure element. For example, the elasticity of an elastic structure can be limited or prevented in order to block the height adjustment device. Or their elastic effect can be prevented by using an inelastic element to limit the extent of the elastic effect.

Preferably, the height pressure element of the height adjustment device comprises a gas spring. The gas spring can be designed in particular so that it is extended to a zero position and thus pushes the seat away from the foot part. By means of the height pressure element, the chair can always be at a maximum seat height when it is not being used or when the seat is not being loaded. On the one hand, this enables efficient adjustment of the preferred individual seat height and, on the other, a stand-up aid.

The blocking structure preferably has a release mechanism, which is configured to release the gas spring of the height adjustment device when actuated, and a locking mechanism, which is configured to lock the gas spring of the height adjustment device when actuated. Gas springs are typically equipped with a valve. In many versions, the gas spring acts when the valve is open and is rigid when the valve is closed. The release mechanism can be designed in such a manner that it opens the valve of the gas spring when actuated, and the locking mechanism can be designed in such a manner that it closes the valve of the gas spring when actuated.

The release and locking mechanisms can be designed in different ways to suit the design of the chair. In particular, in addition to the preferred mechanism for locking and releasing the gas spring described in more detail below, numerous other design solutions are possible which enable the valve of the gas spring to be actuated. For example, they could comprise one switch each. They can also be realized as an integral construction in which the same mechanism functions in different states as a locking mechanism or as a release mechanism. In such a design, one can speak of a block-release mechanism. The release or locking mechanisms can also be equipped with electronic components such as sensory systems or circuits so that, for example, the actuation of the gas spring can be triggered depending on an electronically determined angle of the seat.

Here, the seat and the locking mechanism of the blocking structure are preferably arranged such that the seat actuates the locking mechanism when the height of the buttock section of the seat carrier and the height of the knee section of the seat carrier are in the target position relative to one another.

The locking mechanism of the blocking structure is preferably coupled to a valve of the gas spring of the height adjustment device in such a manner that the valve is switched when the locking mechanism is actuated. In this manner, the blocking structure can be implemented simply and effectively.

Preferably, the locking mechanism comprises a slide, a guide and a rocker, wherein the slide is coupled to the guide or assembled in the guide such that it is movable along the guide, wherein the rocker is coupled to the valve such that it closes the valve in a first tilted, wherein the slide is coupled to the seat carrier so that it is moved along the guide when the seat carrier tilts, particularly about the tilting axis, and wherein the slide is moved along the guide so that it tilts the rocker into the first tilted position when the seat carrier of the seat is tilted to a predefined target inclination. Such a locking mechanism can enable a stable and practical realization of the blocking structure.

The seat and the release mechanism of the blocking structure are preferably arranged so that the seat actuates the release mechanism when the height of the seat carrier's buttock section and the height of the seat carrier's knee section are outside the target position relative to one another. For example, the position of the buttock section and the knee section outside the target position can be a position in the home position or, advantageously, a position between the target position and the home position.

The release mechanism of the blocking structure is preferably coupled to a valve of the gas spring of the height adjustment device in such a manner that the valve is switched when the release mechanism is actuated. In this manner, the blocking structure can be implemented simply and effectively.

In another aspect, the invention is a furniture composition comprising a chair as described above and a height-adjustable table, wherein the chair has a transmitting unit and the table has a receiving unit. The chair's transmitting unit is configured to transmit a height signal representing a seat height when the blocking structure blocks the height adjustment device. The receiving device of the table is configured to receive the height signal and automatically adjust the table height to the seat height based on the height signal. Such a furniture composition enables the seat height of the chair to be automatically adjusted to the user as described above and at the same time the table height is automatically adjusted to the set seat height. This enables particularly efficient adaptation of a workstation to the user's individual circumstances.

BRIEF DESCRIPTION OF THE DRAWINGS

Further advantageous embodiments of the invention emerge from the following description of exemplary embodiments of the invention with the aid of the schematic drawing. In particular, the chair according to the invention is described in detail below with reference to the accompanying drawings on the basis of embodiments. In the drawings.

DETAILED DESCRIPTION OF THE INVENTION

Figure 1:
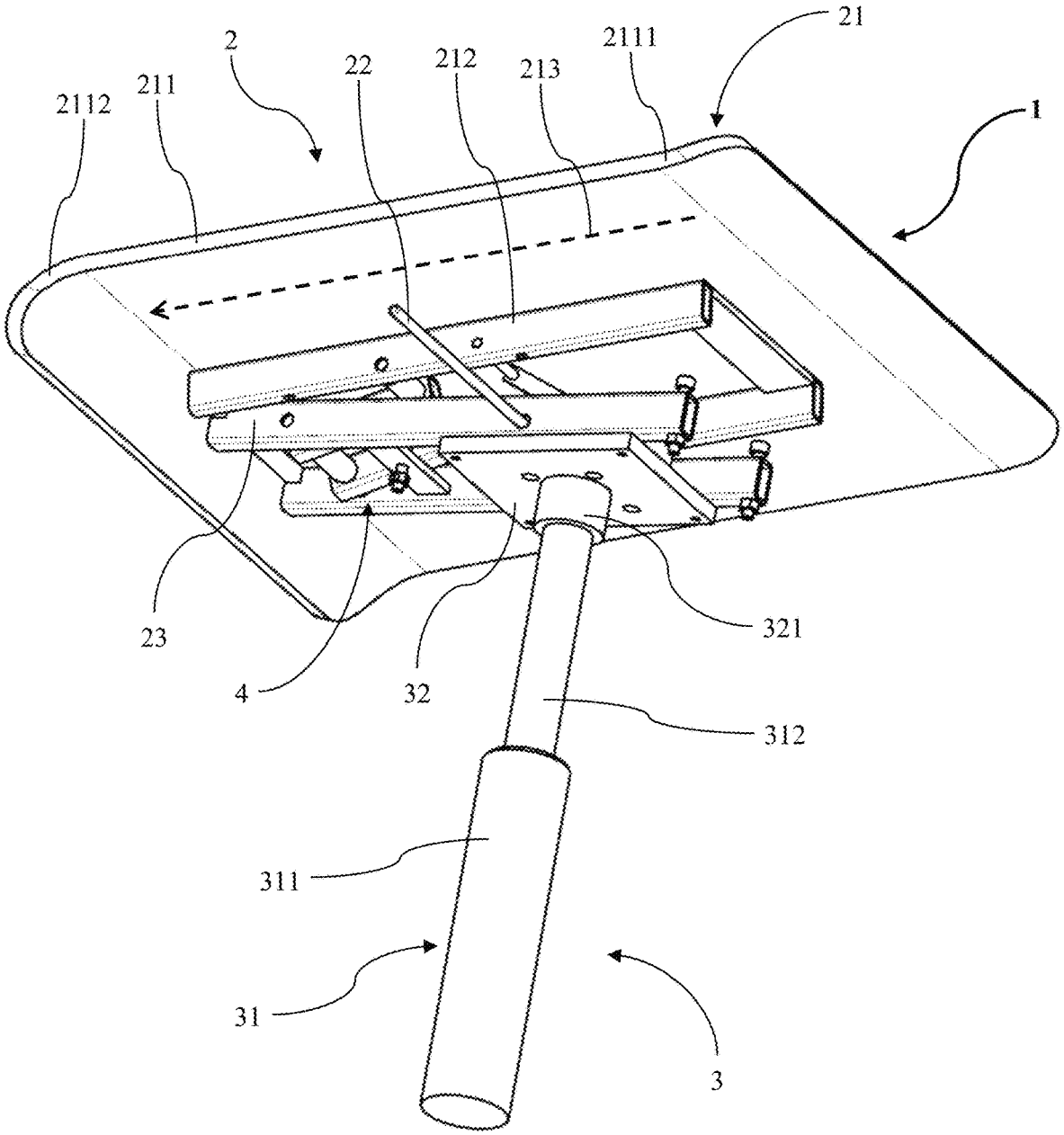
FIG. 1 shows a perspective view of an exemplary embodiment of a chair according to the invention.

Certain expressions are used in the following description for practical reasons and are not to be understood as limiting. The words "right," "left," "bottom" and "top" denote directions in the drawing to which reference is made. The expressions "inward," "outward," "below," "above," "on the left," "on the right" or the like are used to describe the arrangement of designated parts relative to one another, the movement of designated parts relative to one another and the directions toward or away from the geometric center of the invention and designated parts thereof as shown in the figures. This spatial relative information also comprises other positions and orientations than those shown in the figures. For example, when a part shown in the figure is inverted, elements or features that are described as "below" are then "above." The terminology comprises the words expressly mentioned above, their derivations and words with similar meanings.

In order to avoid repetition in the figures and the associated description of the various aspects and exemplary embodiments, certain features are to be understood collectively for different aspects and exemplary embodiments. The omission of an aspect in the description or in a figure does not suggest that this aspect is lacking in the associated exemplary embodiment. Rather, such omissions are made for the sake of clarity and to avoid repetition. In this context, the following stipulation applies to the entire further description: If reference numerals are contained in a figure for the purpose of graphic unambiguity but are not mentioned in the directly associated descriptive text, reference is made to their explanation in preceding figure descriptions. If reference signs are also mentioned in the text of the description relating directly to a figure that are not included in the corresponding figure, reference is made to the preceding and following figures. Similar reference signs in two or more figures represent similar or identical elements.

FIG. 1 shows a perspective view of an exemplary embodiment of a chair 1 according to the invention with a seat 2, a height adjustment device 3 and a blocking structure 4. The height adjustment device 3 comprises a gas spring 31 and a coupling part 32. The coupling part 32 is equipped with a sleeve-shaped gas spring holder 321, which embraces a longitudinal end of the gas spring 31.

The seat 2 comprises a seat carrier 21 with a seat plate 211 and a seat carrier frame 212, a manual release lever 22 and a base frame 23. The base frame 23 is fixedly connected to the coupling part 32, so that the base frame 23 and the coupling part 32 form a unit. The seat plate 211 has a rear, slightly upwardly curved buttock section 2111 and a front, slightly downwardly curved knee section 2112. The seat plate 211 defines a seating direction 213 from the buttock section 2111 to the knee section 2112.

Figure 2:
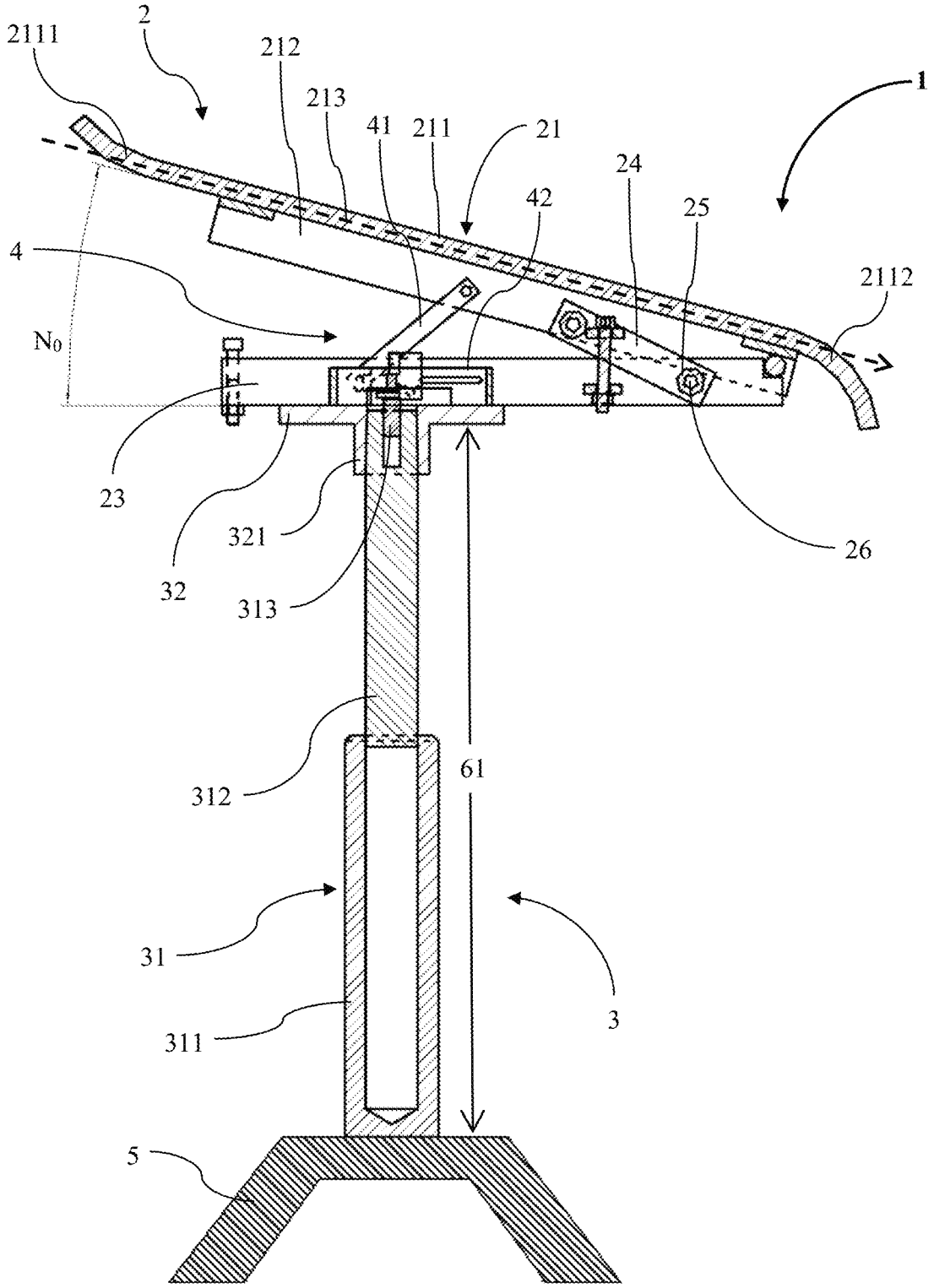
FIG. 2 shows a side sectional view of the chair in FIG. 1 in a basic position.

In FIG. 2, the chair 1 is shown in a sectional side view, wherein it is in a basic position. In particular, the height of the buttock section 2111 of the seat plate 211 and the height of the knee section 2112 of the seat plate 211 are in a basic position relative to one another or a height ratio between the buttock section and the knee section is in a basic position or has a basic size. The chair 1 comprises a foot part 5, which is intended to be placed on a base or similar surface. The gas spring 31 of the height adjustment device 3 has an upright gas cylinder 311 with a hollow interior space, a piston rod 312 and a valve 313. The piston rod 312 extends from the top into the hollow interior space of the gas cylinder 311.

In the basic position of the seat shown in FIG. 2, the gas spring 31 is fully extended. This means that the piston rod 312 is pushed out of the gas cylinder 311 by the gas in the interior space of the gas cylinder 311 to the maximum extent possible. As a result, the coupling part 32 and with it the seat 2 is pushed away from the foot part 5 as far as possible and the seat 2 or the coupling part 32 is at a basic distance 61 from the foot part 5.

The seat carrier frame 212 of the seat carrier 21 of the seat 2 is fastened in a stationary manner to an underside of the seat plate 211, so that the seat carrier frame 212 and the seat plate 211 form a unit. The seat carrier frame 212 is coupled approximately centrally rotatably to a hinge rod 41 of the blocking structure 4. The hinge rod 41 is in turn rotatably connected to a slide 42 of the blocking structure 4, so that the seat carrier frame 212 is connected in a hinged manner to the slide 42. The seat 2 comprises a tilting arm 24, which connects the seat carrier frame 212 to the base frame 23 so that it can tilt about a tilting axis 26 extending at right angles to the seat direction 213. A torsion spring 25 is provided on the tilting axis 26, the spring force of which deflects the seat carrier frame 212 to the maximum relative to the base frame 23, so that the seat plate 211 describes a basic inclination $N_0$. In the basic inclination $N_0$, a difference in a height of the buttock section 2111 of the seat plate 211 and a height of the knee section 2112 of the seat plate 211 is maximum, so that a height ratio between the buttock section 2111 and the knee section 2112 is also maximum.

Figure 3:
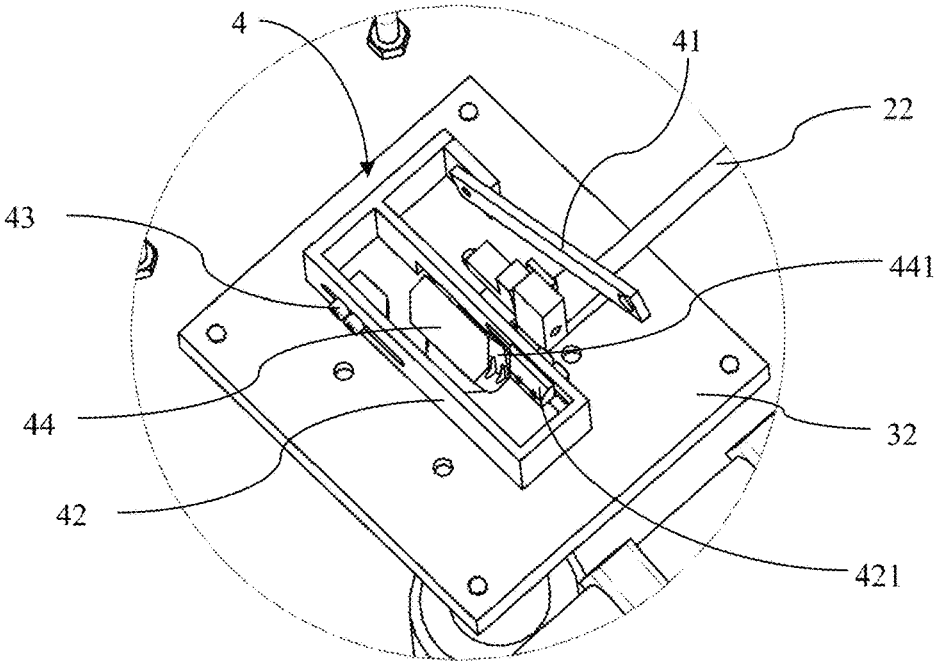
FIG. 3 shows a perspective view of a blocking structure of the chair of FIG. 1.

FIG. 3 shows a more detailed perspective view of the blocking structure 4. In addition to the hinge rod 41 and the slide 42, the blocking structure 4 comprises a slide guide 43 and a rocker 44. The slide 42 is assembled on the coupling part 32 of the height adjustment device 3 via the slide guide 43 in such a manner that it can be displaced linearly to the coupling part 32 within a predefined range. The rocker 44 is arranged in the slide 42 and has a beveled face side 441. The slide 42 is equipped with a ramp element 421 that is associated with the face side 441 of the rocker 44. In particular, in a displacement position of the slide 42 along the slide guide 43, it contacts the end face 441 and during a further displacement of the slide 42 it tilts the rocker 44.

Figure 4:
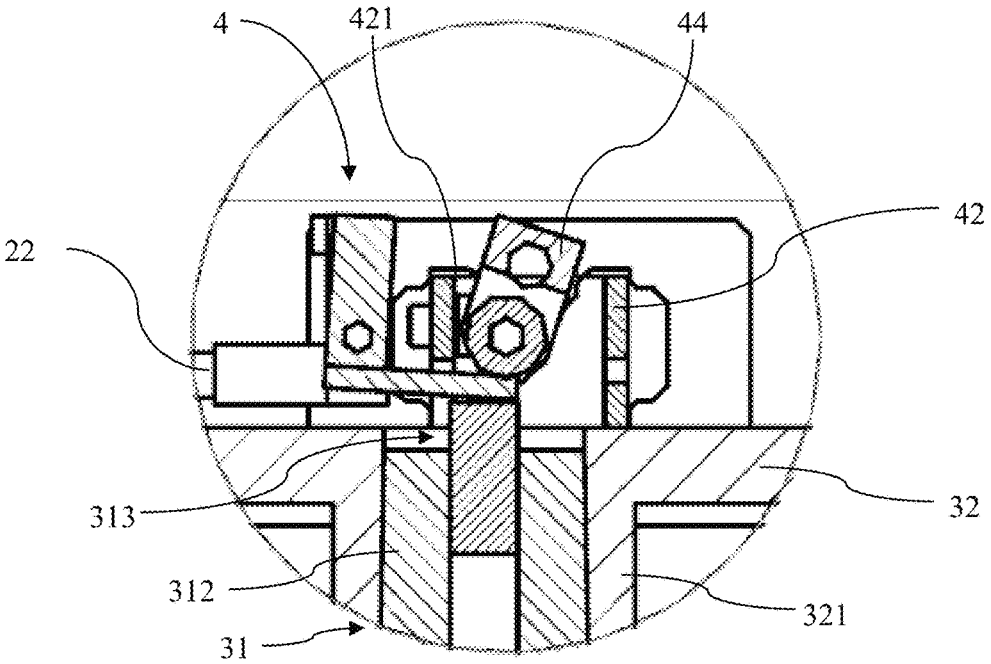
FIG. 4 shows a sectional view of the blocking structure of FIG. 3 in a released position, wherein a rocker of the blocking structure is in a first tilted position.

As can be seen in the cross-sectional view of FIG. 4, the rocker 44 is coupled to the valve 313 of the gas spring 31. In the basic position of the chair 1, the valve 313 of the gas spring 31 is open. When the seat plate 211 is unloaded, the seat plate 211 is pushed upwards accordingly by the gas spring 31 and the chair 1 is at the highest seat height. The rocker 44 is not engaged with the ramp element 421 of the slide 42 and is tilted to a first tilted position—to the left in the view of FIG. 4. As mentioned, the valve 313 of the gas spring 31 is open in this position.

Figure 5:
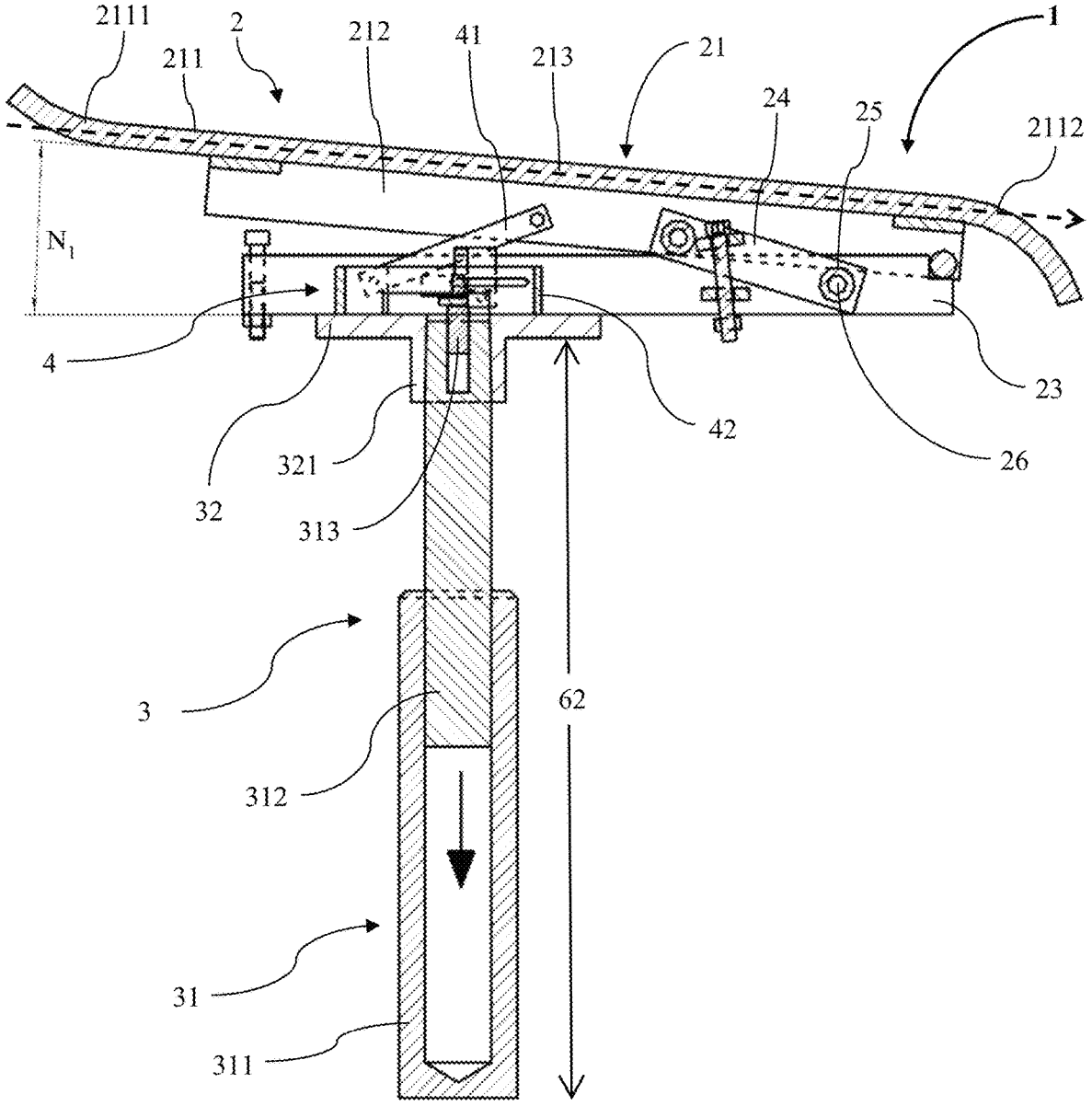
FIG. 5 shows a side sectional view of the chair in FIG. 1 during a loading process.

FIG. 5 shows the chair 1 while it is being loaded. The user sits on the seat plate 211 with his buttocks against the buttock section 2111. As a result, on the one hand the seat plate 211 is increasingly tilted about the tilting axis 26 in accordance with an inclination of the user's thighs, counter to the spring force of the torsion spring 25, so that the seat plate 211 describes an intermediate inclination $N_1$. The intermediate inclination $N_1$ is smaller than the basic inclination $N_0$. By tilting the seat plate 211 from the basic inclination $N_0$ to the intermediate inclination $N_1$, the hinge rod 41 pushes the slide 42 backwards. In this manner, the ramp portion 421 is moved towards the end face 441 of the rocker 44. However, the rocker 44 is not yet tilted and the valve 313 of the gas spring 31 is still open.

On the other hand, when the user sits down, the weight of the user presses the piston rod 312 of the gas spring 31 into the gas cylinder 311. The gas arranged in the interior space of the gas cylinder 311 is thereby compressed and the gas spring 31 is pushed together. In this manner, the seat 2 is moved towards the foot part 5 in such a manner that the seat 2 and the foot part 5 are at an intermediate distance 62 from one another. The intermediate distance 62 is smaller than the basic distance 61 and the seat height of chair 1 is reduced accordingly.

Figure 6:
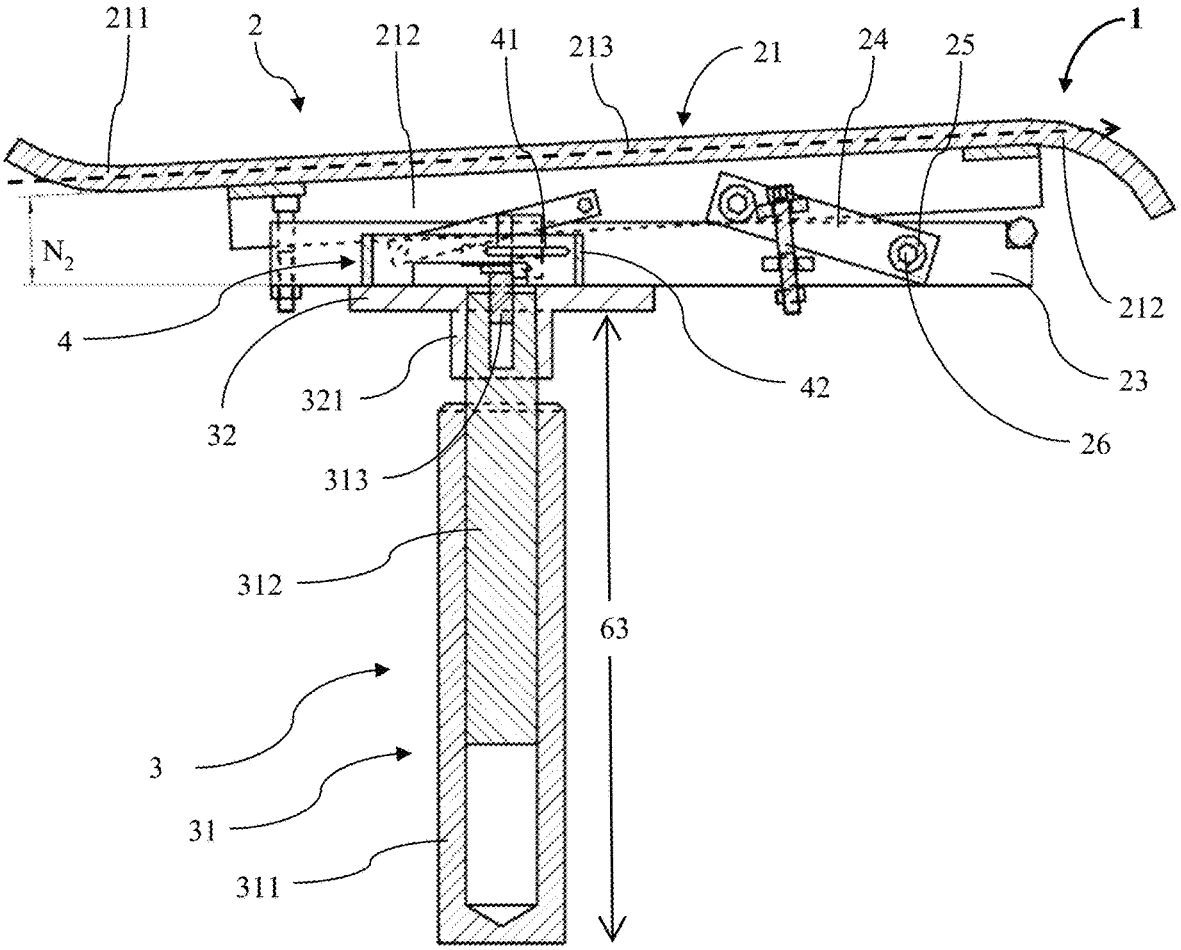
FIG. 6 shows a side sectional view of the chair of FIG. 1 in a target position.

In FIG. 6, the chair 1 is shown in an end position in which the height of the buttock section 2111 of the seat plate 211 and the height of the knee section 2112 of the seat plate 211 are in a target position relative to one another or in which the height ratio between the buttock section and the knee section is in a target position or has a target size. In the target position, the height ratio is lower than in the home position. When sitting down, the user has tilted the seat plate 211 around the tilting axis 26 against the spring force of the torsion spring 25 so that it is aligned quasi horizontally or tilted slightly backwards at a target inclination $N_3$. The target inclination $N_3$ is smaller than the intermediate inclination $N_2$. The user's thighs are also virtually horizontal in the target position, which corresponds to a predefined preferred sitting position.

Figure 7:
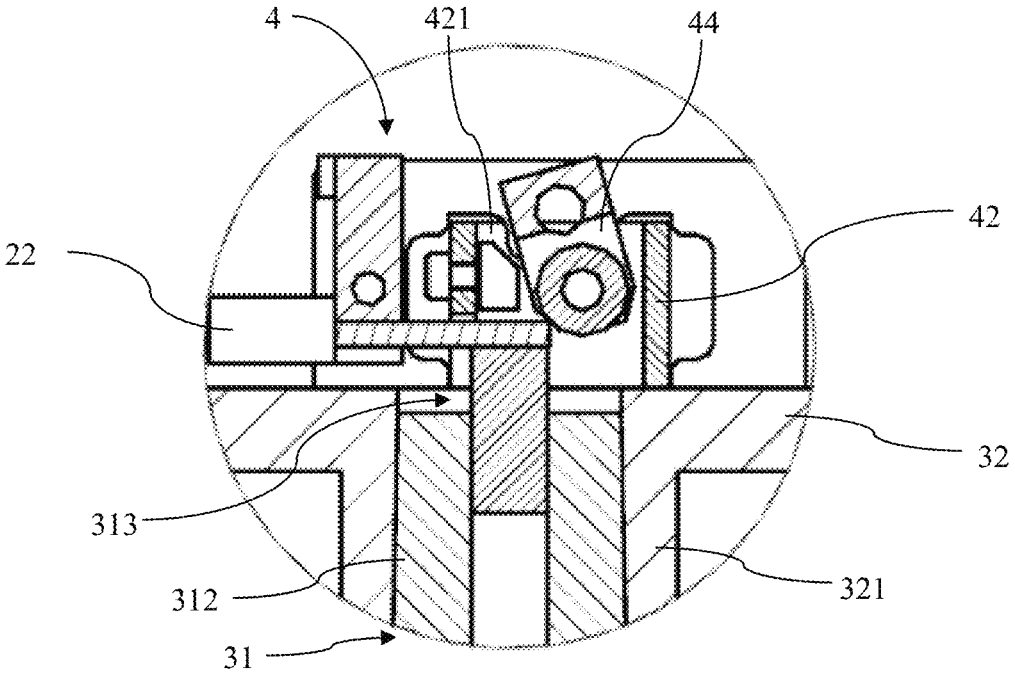
FIG. 7 shows a perspective view of the blocking structure of FIG. 3 in a blocked position, wherein the rocker of the blocking structure is in a second tilted position.

In the target position, the slide 42 is pressed or pushed further back along the slide guide 43 by the hinge rod 41. As can be seen in FIG. 7, the ramp portion 421 thereby presses on the rocker 44 and tilts it into a second tilted position—to the right in the view of FIG. 4. This closes the valve 313 of the gas spring 31 and the gas spring 31 is blocked or rigid. The rocker 44 and the ramp element 421 thus together form a locking mechanism. Thus, the seat height in the target position is fixed at a target distance 63 between coupling part 32 or seat 2 and foot part 5 and adjusted to suit the user.

When the user protrusions from the chair 1 again, the seat plate 211 is pushed upwards about the tilting axis 26 by the spring force of the torsion spring 25 until it is again at the basic inclination $N_0$ to the base frame 23. This causes the slide 42 of the blocking structure 4 to be pulled forward by the hinge rod 41. The ramp portion 421 moves away from the rocker 44 again and this tilts back in the other direction, so that the valve 313 of the gas spring 31 is opened. The rocker 44 and the ramp element 421 thus together form a release mechanism. As a result, the spring force of the gas spring 31 acts on the seat plate 211 and pushes it vertically upwards. The seat height is increased again accordingly until the basic distance 61 is restored. Chair 1 is now back in the starting position or home position and ready for the next user.

By equipping the chair 1 with a manual release lever 22, the seat height of the chair 1 can also be adjusted manually. In particular, for example, the manual release lever 22 can be used to manually open the valve 313 so that the distance between foot part 5 and seat 2 can be changed. This allows the seat height to be readjusted if the automatically set seat height does not meet the user's precise preferences.

Although the invention is illustrated and described in detail by means of the figures and the accompanying description, such illustration and detailed description are to be understood as illustrative and exemplary and do not limit the invention. In order not to obscure the invention, well-known structures and techniques may not be shown and described in detail in certain cases. It is understood that a person skilled in the art can make changes and modifications without departing from the scope of the following claims. In particular, the present invention covers further exemplary embodiments with any combinations of features that may deviate from the explicitly described feature combinations.

The present disclosure also includes embodiments having any combination of features that are mentioned or shown above or below with respect to various embodiments. It also includes individual features in the figures, even if they are shown there in connection with other features and/or are not mentioned above or below. Alternatives of embodiments described in the figures and the description and individual alternatives of their features can also be excluded from the subject matter of the invention or from the disclosed subject matter. The disclosure includes embodiments comprising exclusively the features described in the claims or in the exemplary embodiments and those comprising additional features. The disclosure also comprises intermediate generalizations of features or groups of features of exemplary embodiments shown in the figures and the associated portions of the description. In other words, specific features or groups of features as disclosed in the figures and the associated portions of the description can be combined in the more general embodiments of the invention as disclosed in connection with the description of the invention. In particular, such specific features or groups of features can be provided in the more general embodiments of the invention independently of further specific features shown in the figures. For example, the blocking structure shown in FIG. can be designed with a locking mechanism other than the slide, guide and rocker shown in FIG. 1*n* particular, a different mechanism can be used if the construction of the chair differs. It is understood that persons skilled in art will be able to incorporate specific features from the description of the figures into the embodiments of the description of the invention.

Furthermore, the expression "comprise" and derivations thereof do not exclude other elements or steps. Likewise, the indefinite article "a" or "an" and derivations thereof do not exclude a plurality. The functions of several features listed in the claims can be performed by one unit or one step. The terms "substantially," "about," "approximately," "quasi" and the like in connection with a property or a value in particular also define exactly the property or exactly the value. The terms "about" and "approximately" in connection with a given numerical value or range can refer to a value or range that lies within 20%, within 10%, within 5% or within 2% of the given value or range. All reference signs in the claims are not to be understood as limiting the scope of the claims.

The invention claimed is:

1. A chair, comprising:

a seat comprising a seat carrier with a rear buttock section and a front knee section;

a height adjustment device which is coupled to the seat;

a foot part configured to be placed on a surface; and a blocking structure, wherein the height adjustment device is configured to change a distance between the seat and the foot part, wherein the seat is configured in such a manner that a height of the buttock section of the seat carrier and a height of the knee section of the seat carrier can be changed relative to one another, and wherein the blocking structure is configured to automatically block the height adjustment device when the height of the buttock section of the seat carrier and the height of the knee section of the seat carrier are in a target position relative to one another.

2. The chair of claim 1, wherein, to change the height of the buttock section of the seat carrier and the height of the knee section of the seat carrier relative to one another, the seat is configured to tilt the seat carrier about a tilting axis, wherein the blocking structure is configured to block the height adjustment device when the seat carrier of the seat is tilted to a predefined target inclination.

3. The chair of claim 2, wherein the seat defines a seat direction from the buttock section to the knee section and wherein the tilting axis extends substantially at a right angle to the seat direction.

4. The chair of claim 3, wherein the seat carrier is mounted for tilting about the tilting axis.

5. The chair of claim 1, wherein the seat comprises a seat carrier pressure element which presses the height of the buttock section of the seat carrier and the height of the knee section of the seat carrier relative to one another into a home position, wherein the home position is different from the target position.

6. The chair of claim 5, wherein the seat carrier pressure element comprises a spring.

7. The chair of claim 1, wherein the height adjustment device has a height pressure element which pushes the seat away from the foot part.

8. The chair of claim 7, wherein the height pressure element of the height adjustment device has a gas spring.

9. The chair of claim 8, wherein the blocking structure has a release mechanism which is configured to release the gas spring of the height adjustment device when actuated, and a locking mechanism which is configured to lock the gas spring of the height adjustment device when actuated.

10. The chair of claim 9, wherein the seat and the locking mechanism of the blocking structure are arranged in such a manner that the seat actuates the locking mechanism when the height of the buttock section of the seat carrier and the height of the knee section of the seat carrier are in the target position relative to one another.

11. The chair of claim 10, wherein the locking mechanism of the blocking structure is coupled to a valve of the gas spring of the height adjustment device such that the valve is repositioned when the locking mechanism is actuated.

12. The chair of claim 11, wherein, to change the height of the buttock section of the seat carrier and the height of the knee section of the seat carrier relative to one another, the seat is configured to tilt the seat carrier about a tilting axis, wherein the blocking structure is configured to block the height adjustment device when the seat carrier of the seat is tilted to a predefined target inclination, wherein the locking mechanism comprises a slide, a guide and a rocker, wherein the slide is coupled to the guide in such a manner that it is movable along the guide, wherein the rocker is coupled to the valve in such a manner that it closes the valve in a first tilted position, wherein the slide is coupled to the seat carrier such that it is moved along the guide when the seat carrier tilts, and wherein the slide is moved along the guide such that it tilts the rocker to the first tilt position when the seat carrier of the seat is tilted to a predefined target inclination.

13. The chair of claim 9, wherein the seat and the release mechanism of the blocking structure are arranged in such a manner that the seat actuates the release mechanism when the height of the buttock section of the seat carrier and the height of the knee section of the seat carrier are outside the target position relative to one another.

14. The chair of claim 13, wherein the release mechanism of the blocking structure is coupled to a valve of the gas spring of the height adjustment device such that the valve is adjusted when the release mechanism is actuated.

* * * * *